United States Patent [19]

Johnson

[11] Patent Number: 4,625,941

[45] Date of Patent: Dec. 2, 1986

[54] GAS LIFT VALVE

[75] Inventor: Joseph L. Johnson, Houston, Tex.

[73] Assignee: Priess-Johnson Oil Tools International, Inc., Houston, Tex.

[21] Appl. No.: 726,113

[22] Filed: Apr. 23, 1985

[51] Int. Cl.[4] ..... F16K 31/12

[52] U.S. Cl. ..... 251/12; 137/155; 417/112

[58] Field of Search ..... 251/12, 35, 33, 37; 137/111, 155, 153; 417/110, 112, 113

[56] References Cited

U.S. PATENT DOCUMENTS

| | | | |
|---|---|---|---|
| 2,278,420 | 4/1942 | Boynton . | |
| 2,339,487 | 1/1944 | King . | |
| 2,519,242 | 8/1950 | Garrett et al. . | |
| 2,620,740 | 12/1952 | Garrett et al. . | |
| 2,620,741 | 12/1952 | Garrett et al. . | |
| 2,685,886 | 8/1954 | Peters . | |
| 2,994,335 | 8/1961 | Dudley | 137/155 |
| 3,014,500 | 12/1961 | McGowen, Jr. | 137/155 X |
| 4,151,857 | 5/1979 | DeMoss et al. | 137/155 |
| 4,239,082 | 12/1980 | Terral | 137/155 X |

OTHER PUBLICATIONS

"The Technology of Artificial Lift Methods," vol. 2a, *Introduction of Artificial Lift Systems Beam Pumping: Design and Analysis Gas Lift;* by Kermit E. Brown, The University of Tulsa, Petroleum Publishing Co., Tulsa, pp. 97, 98, 111 and 112 (1980).

"Gas Lift Theory and Practice, Including a Review of Petroleum Engineering Fundamentals," by Kermit E. Brown, The Petroleum Publishing Co., Tulsa, pp. 203, 204 (1967).

*Primary Examiner*—Larry Jones

*Attorney, Agent, or Firm*—Browning, Bushman, Zamecki & Anderson

[57] ABSTRACT

A pressure-operated valve is disclosed including a choke positioned between one or more inlet ports to the valve and a flow port within the valve defined by a seat to which a valve element may be sealed to close the valve. The choke includes one or more orifices to provide a constricted flow path such that control fluid, entering the inlet port, experiences a pressure drop before reaching the flow port, whereby fluid pressure downstream of the flow port may effectively control the configuration of the seat-and-valve element combination. The choke, which is sealed within the valve to prevent fluid flow around the choke, may be positioned at the inlet port to receive fluid flow into the valve.

8 Claims, 4 Drawing Figures

FIG. 1
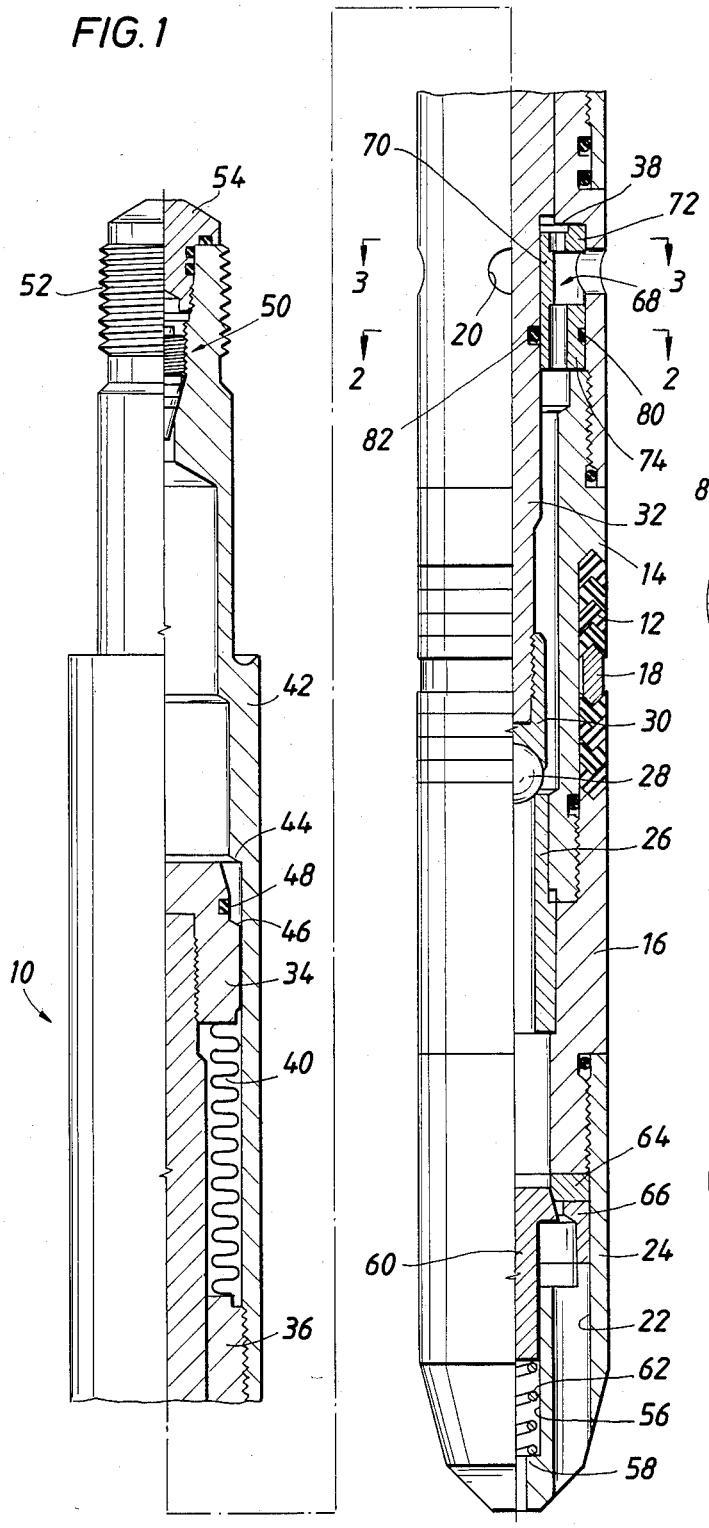
FIG. 2
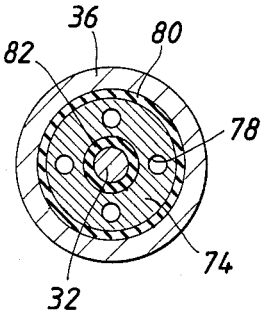
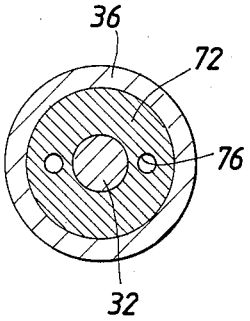
FIG. 3

GAS LIFT VALVE

BACKGROUND OF THE INVENTION

1. Field of the Invention

The present invention pertains to pressure-operated valves. More particularly, the present invention relates to continuous operation, pressure-regulated valves, wherein such a valve may be opened to permit more or less fluid flow therethrough based, at least in part, on the amount of pressure applied to the valve generally from the downstream side. The present invention finds particular application to gas lift valves for use in gas lift operations in the production of fluid from wells, for example.

2. Discussion of Prior Art

Gas lift valves are known for use in gas lift operations in the production of fluid from wells, such as oil wells. Such valves may be positioned at selected depths in the well, and serve to control the flow of gas from a control line or casing surrounding the tubing string through which fluid is to be produced, and the interior of the tubing string. Infusion of such gas into the oil, for example, reduces the density of the oil and allows the oil at the level of the gas influx to be elevated by oil of greater density below. As the density of the oil decreases, and the oil becomes lighter, the oil tends to apply less pressure on the gas lift valve, and on higher gas lift valves along the well, which might be closed.

In general, such a gas lift valve may be pressure-operated so that the opening and closing of the valve may be controlled. The gas under pressure to be introduced into the liquid also provides a control pressure which, when applied to the valve, may urge the valve open against forces tending to maintain the valve closed. Such closing forces may be applied by a spring, for example, in addition to a charging fluid, such as nitrogen gas, for example. The charging fluid is applied to the valve prior to its introduction into the well, and sets a reference pressure against which forces tending to open the valve must work. With the valve in place and its outlet exposed to the fluid in the production tubing, the production tubing pressure also urges the valve to open. However, the ultimate control of the valve lies to a substantial extent with the pressure of the control gas. Thus, to close the valve or to adjust the amount the valve is open for communication of gas therethrough, the pressure of the control gas is adjusted by appropriate operations at the surface.

It is advantageous, however, to provide a gas lift valve whose configuration may be controlled by the pressure in the tubing at the level of the valve, without the necessity of monitoring that pressure from the surface, for example. Such a valve may be referred to as a continuous lift, or continuous operation, valve. To achieve such continuous operation, the valve may be constructed to provide the input control gas with a pressure drop other than at the operable opening of the valve, that is, between the valve element and its seat. This may be achieved by use of an orifice arrangement, whereby the control gas input to the valve must flow through a constriction and thus undergo a pressure drop before being introduced into the tubing string through the valve opening. Then, the tubing string pressure may exert the predominant influence to control the configuration of the valve, that is, to determine whether and to what extent the valve is open. When the fluid pressure in the tubing string at the level of the valve decreases, reflecting a decrease in the density of the liquid at that level, the valve may be closed partly or completely, under the influence of the gas charge and the spring device for example, and the liquid elevated by the greater density liquid below without influx, or with limited influx, of control gas into the liquid. When the pressure in the tubing string at the valve increases, reflecting liquid of greater density at that level, the valve is opened, or opened to a greater extent, due to the increase in fluid pressure urging the valve opened, to permit an influx, or greater influx, of control gas into the tubing string to lower the density of the liquid for production.

It is further advantageous to provide such a continuous lift valve with a readily replaceable orifice component, since such a constriction may be particularly exposed to damage through erosion due to particles that may be carried by the inflowing control gas. It is also advantageous to provide such a gas lift valve with a readily replaceable component which bears the brunt of any such erosion caused by particles carried by the gas as the control gas is initially inlet into the interior of the valve itself. The present invention provides such advantages.

SUMMARY OF THE INVENTION

The present invention provides pressure resonsive valve apparatus including a housing featuring inlet and outlet ports. A flow port within the housing is defined by a seat between the inlet and outlet ports, and a valve member may sealingly engage the seat to close the flow port. One of the valve member and seat is movable whereby the configuration of the flow port is determined. Force to urge the flow port closed may be provided, for example, by pressurized fluid or a resilient device. A choke provides at least one orifice between the inlet port and the flow port, the orifice establishing a constricted flow area whereby fluid flowing therethrough experiences a pressure drop. The choke may be sealed, including sealing to the movable one of the valve member or seat. Further, the choke may be generally aligned relative to the inlet port to receive fluid flowing through the inlet port to the interior of the housing.

The seat may be provided as an annular seating surface, and the valve element may be provided as a ball valve. The movable element, such as the ball valve, may be carried by an elongate member movable relative to the housing, and the choke may generally circumscribe the elongate member and be sealed thereto. Then, the elongate member may so move relative to the choke while remaining sealed thereto.

In particular, the present invention may be provided as a pressure-operated, continuous lift gas lift valve.

The present invention thus provides a pressure-operated gas lift valve with a choke for establishing a pressure drop across a constricted flow area as control gas flows therethrough before reaching the flow port of the valve. The choke may be aligned with inlet ports of the valve to receive fluid flow therethrough. Further, the choke may be readily replaceable, in the event of erosion damage thereto, for example.

BRIEF DESCRIPTION OF THE DRAWINGS

FIG. 1 is an elevation in partial section of a gas lift valve according to the present invention;

FIG. 2 is a lateral cross section taken along line 2—2 of FIG. 1;

FIG. 3 is a lateral cross section taken along line 3—3 of FIG. 1; and

DESCRIPTION OF PREFERRED EMBODIMENTS

Figure 4:
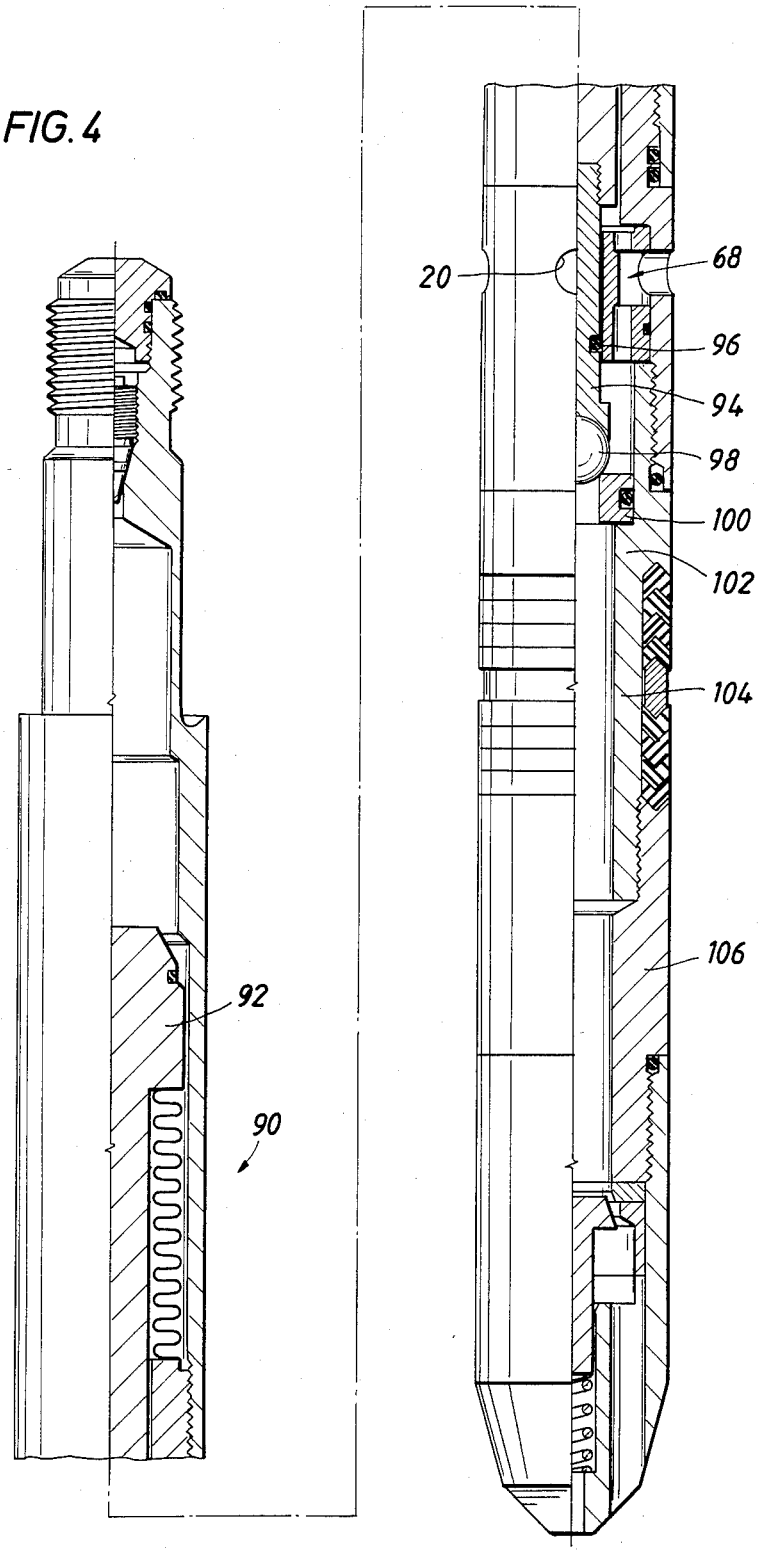
FIG. 4 is an elevation in partial section of another version of a gas lift valve according to the present invention.

A valve according to the present invention is shown generally at 10 in FIG. 1 in the form of a gas lift valve capable of continuous lift operation. The valve 10 is generally elongate in form and provided with an outer housing constructed of several components described hereinbelow. In such form, the gas lift valve 10 is readily receivable within a side pocket mandrel, for example, of the type known for use in gas lift operations in oil wells, for example. Thus, the valve 10 carries about its outer periphery a seal assembly 12 including a plurality of V-seal members, or chevron seals, circumscribing a seat housing 14 and constrained between appropriate shoulders on the seat housing and a check body 16 threadedly engaged with and sealed by O-ring seals to the seat housing. A spacer ring 18 assists in maintaining the chevron seals in proper configuration. As the valve 10 is received in such a side pocket, for example, the seal assembly 12 provides sealing engagement between the valve outer periphery and the side pocket to separate, within the side pocket mandrel, a plurality of gas inlet ports 20, positioned above the seal assembly, and gas outlet ports 22 located toward the bottom of the valve in a check housing 24.

A generally cylindrical seat member 26 is constrained within the housing between the lower end of the seat housing 14 and an appropriate shoulder of the check body 16, and is sealed to the seat housing by an O-ring seal. The upper end of the seat member 26 defines a fluid flow port that may be engaged by a ball valve element 28 to close the interior of the valve 10 against fluid flow and pressure communication. The ball valve 28 is carried at the end of a valve stem 30, which is threadedly connected to the end of a bellows stem 32 extending beyond the area of the inlet ports 20. The opposite end of the bellows stem 32 is threadedly engaged to a bellows bushing 34. A bellows header 36 is threadedly connected and sealed by an O-ring seal to the seat housing 14, and is structured to provide an interior surface which may constrain the bellows stem 32 from lateral movement while permitting longitudinal movement of the bellows stem generally along the interior of the valve 10. The bellows header 36 is also broken by the inlet ports 20 at a position just below an interior annular shoulder 38.

A bellows 40 extends between the bellows bushing 34 and the bellows header 36, to which components the ends of the bellows are attached. Thus, the bellows 40 divides the upper interior of the valve housing into two portions, including an interior and lower portion containing the bellows stem 32, and a portion exterior to the bellows extending upwardly toward the top of the valve 10. With the lower end of the bellows 40 anchored and sealed to the bellows header 36, and the upper end of the bellows anchored and sealed to the bellows bushing 34, which is movable with the bellows stem 32, the bellows expands and contracts as the bellows stem is raised and lowered, respectively, within the valve housing.

The bellows 40 may be constructed of metal providing a spring structure so that the bellows urges the bushing 34 and stem 32 downwardly as the bellows tends to contract toward the header 36.

The bellows 40 is generally circumscribed by a hollow dome 42 which comprises a portion of the valve housing and which is threaded and sealed by O-ring seals to the bellows header 36. The dome 42 includes an internal, frustoconical shoulder 44 which may receive a complementarily formed shoulder 46 of the bellows bushing 34 to limit upward movement of the bushing and, therefore, upper extension of the bellows 40. The bellows bushing 34 carries an O-ring seal 48 which may engage the interior surface of the dome 42 when the bushing shoulder 46 is stopped against the dome shoulder 44 to seal the bushing to the dome.

The dome 42 extends upwardly and has its internal passage blocked by a valve core, shown generally at 50. The valve core 50 is utilized in charging the interior of the dome 42 external to the bellows 40 with a reference pressure, provided by nitrogen gas, for example. The exterior of the upper end of the dome 42 is threaded at 52 to receive a line for communication of such gas, for example. The valve core 50 operates by opening in response to appropriate force thereon to permit flow of the charging gas to the interior of the dome 42. After such charging is complete, the valve core, which is self-closing, is covered and the end of the dome 42 sealed by a plug 54 which is threadedly engaged to the interior of the dome and sealed thereto by O-ring seals.

At the lower end of the valve 10, the check housing 24 has its center broken by a throughbore 56 which may be structured to include an internal annular shoulder 58. A check valve element 60 is constrained against lateral movement by its shank residing within the throughbore 56, and may be urged upwardly within the valve housing by an optional coil spring 62 compressed between the housing shoulder 58 and the bottom of the check valve element. The upper portion of the check valve element 60 extends laterally to be sufficiently wide to engage a gasket 64 operating as a valve seat whereby the interior passage of the valve housing may be closed against upward fluid flow and fluid pressure communication. The spring 62 merely works to maintain the valve element 60 in the vicinity of the gasket 64 without contacting the gasket. The gasket 64 is held in place between the bottom of the check body 16 and the top of a spacer 66 supported from the bottom by the check housing 24. The check valve provided by the check valve element 60 and the gasket seat 64 is a velocity valve, and will close to prevent fluid flow upwardly into the interior of the housing, with such fluid tending to flow upwardly providing pressure to the bottom side of the valve element 60 to force the valve element against the seat. However, fluid may readily flow downwardly through the gasket 64 and past the valve element 60, further compressing the spring 62 if necessary.

The bellows stem 32 is circumscribed by an orifice ring, or choke, shown generally at 68. Details of the choke 68 may be appreciated by reference to FIGS. 2 and 3 in conjunction with FIG. 1. The choke 68 includes a shank 70, an upper flange 72 and a lower flange 74. The upper flange 72 is broken by one or more orifices 76 (two are shown), and the lower flange 74 is broken by one or more orifices 78 (four are shown). The choke 68 is sealed to the interior of the bellows header 36 by an O-ring seal 80 carried in an appropriate groove in the choke at a position below the level of the inlet ports 20. The choke 68 is also sealed to the bellows stem 32 by an O-ring seal 82 carried in an appropriate groove in the bellows stem and providing sliding, sealing engagement between the bellows stem and the interior surface of the choke. The lower orifices 78 are appropriately sized to permit only constricted fluid flow therethrough at limited rates, with the number of such orifices provided depending on the fluid flow rate range desired. The upper orifices 76 generally communicate fluid pressure and little flow. Fluid pressure may also communicate between the upper flange 72 and the header 36.

The gas lift valve 10 is prepared for use in a gas lift operation by having its dome 42 charged to a reference pressure, above the bellows 40, with an incompressible fluid such as water occupying the area between the bellows and the dome approximately to the level of the shoulder 44. The reference pressure is achieved by application of nitrogen gas, for example, through the valve core 50, after which the housing is closed by the plug 54. With the inlet ports 20 as well as the outlet ports 22 exposed to atmospheric pressure, the charge gas in the dome 42 will maintain the ball valve 28 in sealing engagement with the seat 26.

When the valve 10 is fully opened, the bellows bushing 34 engages the dome shoulder 44 to limit upward movement of the bushing and is sealed to the dome 42 by the O-ring seal 48. The liquid trapped between the bellows 40 and the dome 42, below the bushing seal 48, prevents the bellows from distorting outwardly under increased pressure urging the ball valve 28 further upwardly, since such pressure is transmitted to the liquid through the bellows resulting in no substantial pressure differential across the bellows.

The charged valve 10 may be installed in a mandrel positioned within a production line in a well, with the seal members 12 appropriately sealing the valve to the mandrel. Then, the outlet ports 22 are exposed to the pressure within the production tubing and the inlet ports 20 are exposed to control pressure, either from a control line extending to the surface of the well or to the interior of the casing surrounding the production tubing string. In either case, application of gas to the valve interior through the inlet ports 20 may be selectively controlled at the surface by controlling the gas pressure in either the control line or the casing. If the inlet ports 20 are exposed to casing pressure, any liquid within the casing at the level of the inlet ports may be cleared by forcing gas down the well casing, whereby, by means of a U-tube effect, for example, fluid may be cleared from the casing to the level desired with accompanying rise in fluid within the production tubing.

With the inlet ports 20 exposed to control gas, the valve 10 will be opened, that is, the bellows stem 32 and bellows bushing 34 will be lifted, with accompanying extension of the bellows 40, in response to control pressure acting thereon radially external to the ball 28 and seat 26 contact. As control fluid is introduced to the interior of the valve 10 through the inlet ports 20, the control fluid communicates pressure through the upper orifices 76 and around the upper flange 72 to tend to lift the bellows stem 32 and associated parts. At the same time, fluid pressure from the production tubing acts on the ball valve element 28. With sufficient fluid pressure thus urging the bellows stem 32 and associated parts upwardly, the ball valve element 28 may be lifted off of the seat 26 to open the valve flow port for fluid communication therethrough.

After the valve is opened, and as long as the valve remains opened, control fluid may enter the valve housing through the inlet ports 20 and pass between the raised ball valve 28 and the seat 26 to enter the tubing string through the outlet ports 22. There, the control fluid operates to reduce the density of liquid within the tubing string and which is to be produced by flow upwardly to the surface. The control fluid entering the valve 10 undergoes a pressure drop in passing through the orifices 78 in the lower choke flange 74.

Since the control fluid undergoes a pressure drop in passing through the lower orifices 78, the amount of control fluid pressure urging the valve 10 open remains constant, provided the control fluid pressure in the casing remains constant. Then, variations in the tubing pressure operating on the ball valve element 28 and, with the valve open, in general on the bellows stem 32 below the O-ring seal 82, vary the pressure applied to urge the valve open against the pressure charge in the dome 42 and the strength of the bellows 40 operating as a spring. The position of the ball valve 28 relative to the seat 26 will be determined by the balance, or imbalance, between the force of the tubing fluid pressure below the O-ring 82, and the gas charge in the dome 42 and the spring force of the bellows 40.

If pressure in the tubing string drops, which would occur if the density of liquid in the tubing string decreases, the liquid in the tubing string may appropriately be produced with lesser, or no, need for introduction of control gas into the fluid. Accordingly, the decreased pressure urging the valve 10 open would result in the valve closing somewhat, with a consequent reduction in control gas introduced through the valve into the tubing, or even with the valve 10 closing, with the result that no control gas is introduced into the tubing. An increase in fluid pressure in the tubing would accordingly increase the pressure tending to open the valve, and when the total pressure urging the valve open was greater than the charge pressure in the dome 42 and the effect of the bellows 40 acting as a spring, the valve would open. If the pressure in the tubing string so increases, reflecting an increase in the density of liquid in the tubing and a need for an influx of control gas into the liquid to effect production of the liquid, the valve, if closed, would be forced open and the extent to which the valve was open would increase with the tubing string pressure. Thus, with a greater need for control gas to overcome a greater tubing string fluid density, the valve is opened a greater extent, allowing a greater rate of influx of control gas through the valve into the tubing string.

In any event, the configuration of the valve 10, whether opened or closed, and, if open, the extent to which it is open, is determined by the tubing string pressure as opposed to the control gas pressure coming from the casing, wherein the pressure may be maintained constant, for example. This control situation occurs because of the presence of the choke 68 which effects a pressure drop across its lower flange for the inflowing control fluid. In the absence of such a choke 68, the control gas would experience a pressure drop only in passing between the raised ball valve element 28 and the seat 26, and the extent to which the valve 10 would be opened would depend to a great extent on the control gas pressure as applied by means of the casing, with a consequent decrease in the effect of the tubing string pressure on the configuration of the valve 10.

An additional advantage of the use of the choke 68 occurs because the choke shank 70 is at the level of the inlet ports 20. Therefore, the incoming control gas is deflected by the choke shank 70 as opposed to being deflected by a valve stem, for example. Any erosion that may occur due to such deflection of the gas with any particles the gas may be moving occurs in the choke 68, which is then a relatively inexpensive component to replace when the need arises. Additionally, the orifices 78 through which the control gas flows to the tubing string may be renewed by simply replacing the choke 68 rather than a more extensive component, for example.

Another version of a gas lift valve according to the present invention is illustrated generally at 90 in FIG. 4, wherein, in general, only parts which vary in construction from those illustrated in FIGS. 1–3 are labeled and further described herein.

An integrated combination bellows stem and bellows bushing 92 extends downwardly to the vicinity of the choke 68, which now circumscribes an extended valve stem 94. Sliding, sealing engagement between the valve stem 94 and the choke 68 is provided by an O-ring seal 96 carried in an appropriate groove in the valve stem. The lower end of the valve stem 94 continues in a ball valve element 98 which, in the downward position of the bellows bushing-and-stem 92, sealingly engages a seat 100 positioned on an internal, annular shoulder 102 of an appropriately modified seat housing 104. Similarly, a modified check body 106 does not support the seat for the ball valve, as in the case of the valve 10. Aside from the shortening of the bellows stem 92, the positioning of the ball 98 and seat 100 closer to the inlet ports 20 does not alter the function of the valve 90 compared to the function of the valve 10.

The present invention provides a pressure-operated valve capable of continuous lift operation, and featuring an insert choke which is readily replaceable.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. Pressure responsive valve apparatus, comprising:

a. a housing including at least one inlet port and at least one outlet port separated from the inlet port, with all such ports communicating between the interior of the housing and the exterior of the housing;

b. a seat, positioned within the housing between the inlet and outlet ports, generally defining a flow port for flow of fluid between the inlet and outlet ports, and a valve member, with at least one of said seat and said valve member being movable, and whereby said flow port may be selectively closed by sealing engagement between said seat and said valve member, and said flow port may be opened a selected amount to allow selected fluid flow therethrough by relative separation between said seat and said valve member;

c. means for providing force to urge said seat and valve member together to close said flow port; and d. choke means for providing at least one orifice means between said inlet port and said flow port to establish a constricted flow area for fluid flowing between said inlet port and said flow port, wherein said choke means is generally aligned with said inlet port so that fluid entering through said inlet port may impinge on said choke means, whereby a pressure drop may be effected across said orifice between said inlet port and said flow port, and wherein said choke means may be sealed to prevent fluid flow between said inlet port and said flow port other than through said orifice means.

2. Apparatus as defined in claim 1 wherein:

a. the one of said seat and valve member that is movable is carried by an elongate member so movable relative to said housing;

b. said choke means generally circumscribes said elongate member and is sealed thereto; and c. said elongate member may so move relative to said choke means while remaining sealed thereto.

3. Apparatus as defined in claim 1 wherein said choke means is so sealed to the one of said seat and valve member which is movable relative to said housing.

4. Apparatus as defined in claim 1 wherein said seat comprises a generally annular seating surface and said valve member comprises a ball valve.

5. Apparatus as defined in claim 4 wherein said ball valve is so movable relative to said seat which is fixed relative to said housing.

6. Apparatus as defined in claim 1 wherein said means for providing force to urge said flow port closed comprises pressurized fluid.

7. Apparatus as defined in claim 1 wherein said means for providing force to urge said flow port closed comprises resilient means.

8. A pressure-operated gas lift valve comprising:

a. a housing with at least one inlet port separated from at least one outlet port;

b. a valve-and-seat combination, with one of the valve or seat elements movable relative to said housing;

c. means providing force to urge said valve closed by operating on said movable valve element to urge said element toward the other said valve element; and d. a choke positioned generally at said inlet port and sealed to said moving valve element and said valve housing, and further providing at least one constricted flow path;

e. whereby fluid entering through said inlet port may impinge on said choke and must pass through said constricted flow path before passing through said flow port provided by said valve seat so that the pressure of said fluid entering said inlet port is reduced as said fluid passes through said constricted flow path.

* * * * *